US005519897A

United States Patent [19]

DeSimone

[11] Patent Number: 5,519,897

[45] Date of Patent: May 28, 1996

[54] APPARATUS AND METHOD FOR REMOVING TOILET ODORS

[76] Inventor: John DeSimone, 915 Harvard Dr., Palatine, Ill. 60067

[21] Appl. No.: 402,704

[22] Filed: Mar. 13, 1995

[51] Int. Cl.[6] ..... E03D 9/052

[52] U.S. Cl. ..... 4/213

[58] Field of Search ..... 4/213, 221

[56] References Cited

U.S. PATENT DOCUMENTS

| | | | |
|---|---|---|---|
| 2,001,592 | 5/1935 | Teetor | 4/213 |
| 2,846,696 | 8/1958 | Herriott | 4/213 |
| 4,099,047 | 7/1978 | Kirkland | 4/213 X |
| 4,200,940 | 5/1980 | Buchanan | 4/348 |
| 5,054,130 | 10/1991 | Wilson | 4/213 |
| 5,161,262 | 11/1992 | Quaintance | 4/213 |

*Primary Examiner*—Charles E. Phillips
*Attorney, Agent, or Firm*—Charles F. Lind

[57] ABSTRACT

The invention provides a portable apparatus having housing structure with a duck-bill shaped gas inlet that is fitted between the top face of a toilet bowl and the underside of the lowered toilet seat, to open directly to air confined within the bowl. Remaining housing structure defines an air flow path to a gas outlet outside of the toilet bowl. A blower and an electric heater in the housing structure air flow operate for withdrawing and then heating the toilet bowl gases before discharging such gases from the outlet back to the ambient air. By heating the gases to temperatures between 450–1000 degrees F., in sufficient volumes to provide between 5–100 turnover of the confined bowl gases per minute, and discharging the treated gases at temperatures in the range of between 150–400 degrees F. back to the ambient air, most defecation odors are eliminated or minimized.

8 Claims, 2 Drawing Sheets

APPARATUS AND METHOD FOR REMOVING TOILET ODORS

BACKGROUND OF THE INVENTION

Water dispensing toilets have dramatically advanced the technology of human sanitary needs, but nonetheless a major potential problem still exists. Specifically, defecation usage of the toilet can release intense offensive odors, which can not only linger in the generally enclosed bath room but also spread via the airways to and throughout the adjoining rooms.

Exhaust fans are common in modern bath rooms, intended to offer a means for possibly eliminating or minimizing the discomforts of such odors; but such generally offer only marginal relief. Reasons for the limited effectiveness of exhaust fans in removing odors might be due to: the remote spacing between the toilet (close to the floor) and the fan itself (commonly close to or in the room ceiling), allowing the odors to dissipate into the room well before they are drawn away; the need for removing much of the room air then to capture such odors; and the limited air moving capacity of such fans, compared to the room volume.

Chemicals are also used, but such basically only seem to mask the odors, and not remove them from the room air.

SUMMARY OF THE INVENTION

This invention relates to apparatus and method for removing bath room odors from the air, without chemicals.

A basis object of this invention is to provide apparatus and method to remove toilet odors, particularly defecation odors, as such are being generated and from close proximity to the source of the odors, thereby minimizing the escape thereof to the ambient bath room air.

Another basis object of this invention is to provide apparatus and method particularly suited for use as or in a portable accessory easily made operative relative to an existing toilet for removing toilet odors as such are being generated.

A basic method of operation of the invention provides imposing a negative pressure directly on the gases in the confines of the toilet bowl operable to remove such gases from the bowl confines as well as any replacement room air drawn then into the bowl confines, and passing such removed bowl gases over surfaces held at temperatures effective to heat such gases to elevated temperatures for neutralizing odorous gas components therein, by reducing or oxidizing them without flame, and discharging the treated gases with the odors substantially reduced or eliminated therefrom to the ambient room air.

A more detailed method of operation of the invention provides heating the gases to temperatures in the range between 450–1000 degrees F., and withdrawing and treating sufficient volumes of such gases from the confined bowl at a rate to provide approximately between 5–100 turnover of the confined bowl gases per minute, and discharging the treated gases at temperatures in the range of between 150–400 degrees F. back to the ambient air.

A basic feature of apparatus for incorporating the inventive method includes body structure comprised as a tubular body defining a through passageway between a gas inlet open to the bowl confines and a gas outlet open to the ambient room air outside of the toilet bowl, a blower in the passageway suited to remove gases via the gas inlet directly from the bowl confines and force such out the gas outlet, and electric heating elements disposed in the passageway in the flow path of the removed bowl gases effective for providing surfaces at temperatures of the order between 450–1000 degrees F. for heating the flowing gases for neutralizing odorous gas components therein, by reducing or oxidizing them without flame, and discharging the treated gases with the odors substantially reduced or eliminated therefrom at temperatures in the range between 150–400 degrees F. back to the ambient room air.

A more detailed feature of the invention is having the apparatus formed as a portable or accessory device, with housing structure shaping the gas inlet to be fitted between the top of the toilet bowl and the underside of the lowered toilet seat, to open directly to the confined bowl air, with remaining housing structure hanging outside of the toilet bowl and defining the air flow path to the gas outlet, with appropriate blower and heater means in the housing structure air flow path for withdrawing and heating the toilet bowl gases as required before the discharge of the treated gases back to the ambient room air. A flexible power cord from the housing structure can be used to plug into a nearby electrical outlet to energize the blower end heater means.

BRIEF DESCRIPTION OF THE DRAWINGS

These and other objects, features or advantages of the invention will be more fully understood and appreciated after consideration of the following description of the invention, including as a part thereof the accompanying drawings, wherein.

DETAILED DESCRIPTION OF PREFERRED EMBODIMENTS OF THE INVENTION

Figure 1:
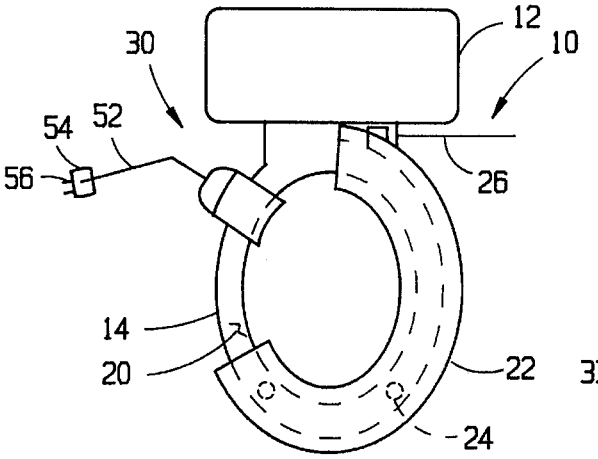
FIG. 1 is a top plan view of a toilet, with part of the seat broken away, showing the inventive apparatus mounted for use thereon at a preferred location.
Figure 4:
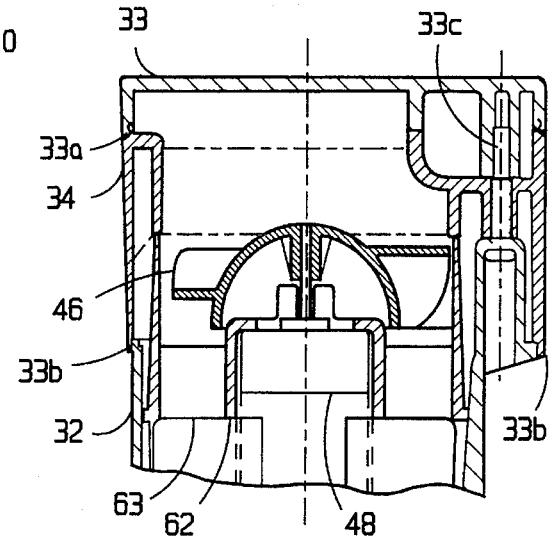
FIGS. 3 and 4 are sectional views, as seen generally from lines 3—3 and 4—4 respectively in FIG. 2.

The invention is disclosed herein as a portable apparatus, that can be easily fitted on a common toilet, and plugged into a nearby electrical outlet, to make it ready for use.

The illustrated conventional toilet 10 has a water closet 12 and connected bowl 14, the bowl having sloping side wall 16 terminating at annular rim 18 with top face 20. A seat 22 is supported on spaced pads 24 in its lowered position, to overlie the top face 20 with only a small vertical clearance; and is hinged relative to the bowl 14 to swing about horizontal axis 26 to its raised position (not shown) against the water closet 12. Water fills the bowl 14 normally to level 28, for example, and air occupies the bowl above the water level. For most commercial toilets, the volume of air confined within the bowl up to the top face 20 might be between 0.2–1.0 cubic feet.

The inventive apparatus 30 illustrated is comprised as adjacent housing components 32, 33 and 34, butted together at reasonably air-tight joints 33*a* and 33*b* and held by screws 33, to defines continuous passageway 32*a* and 34*a* for air flow primarily only between inlet 38 and outlet 40. Electric heater 44 is mounted in the air flow passageway, as is a blower 46 powered by motor 48. Electric power is brought to the apparatus 30 via conventional flexible appliance conductors 52 to ground fault control 54 having male plug 56. A control including on-off switch 50 is suited to regulate power to the heater 44 and air flow motor 48, to provide operation as will be noted.

The apparatus housing component 34 has a flat thin duck-bill like vertical profile, with vertical and horizontal peripherial walls 35*v* and 35*h* respectively sized to be supported on and generally span the bowl top face 20 and to underlie the lowered seat 22. Resilient retainer 36 held in the inlet air flow housing 34 can be snapped past the side of the rim 18 and engage its underside for holding the apparatus in this operative stable position, with housing component wall 37 then snugged against the outside of the toilet bowl 14.

Figure 3:
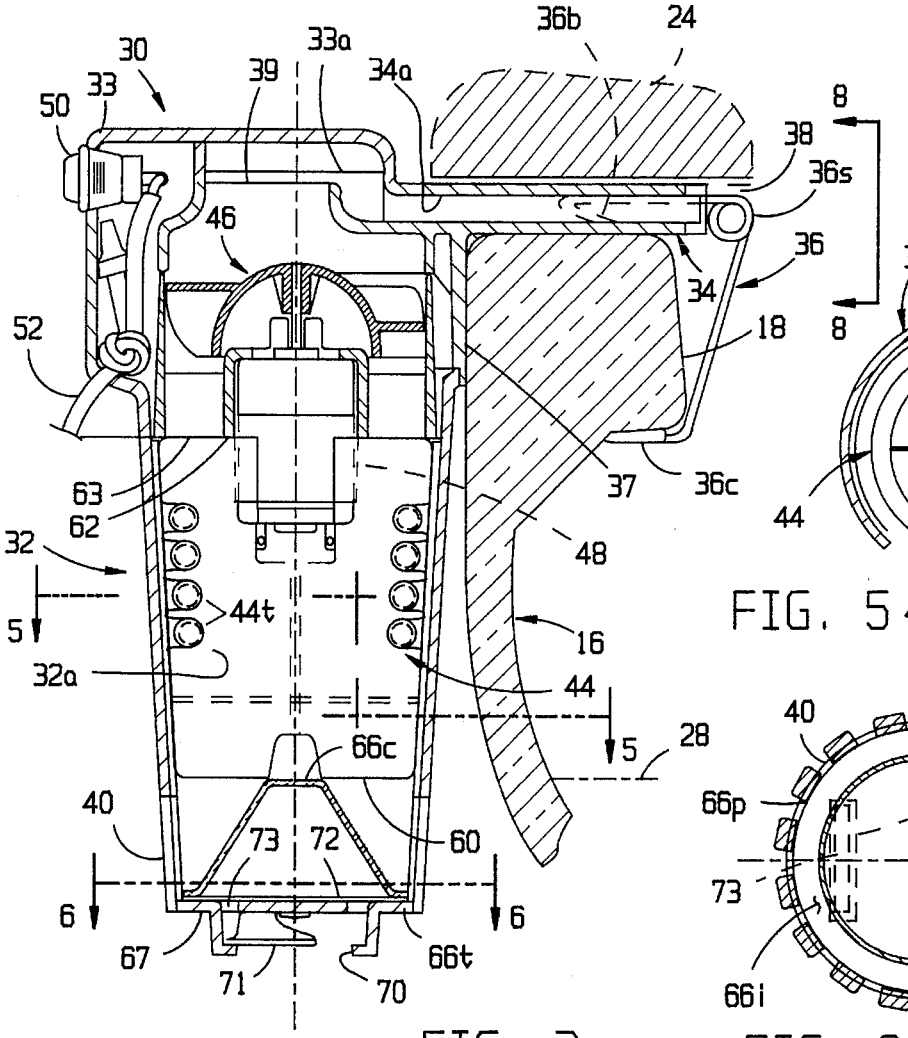
Figure 8:
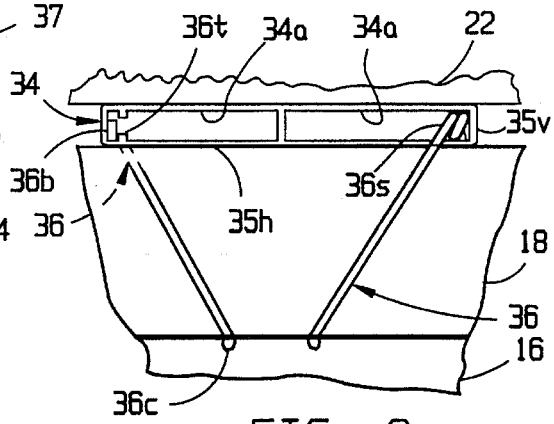
FIG. 8 is a partial right side elevational view of the inlet, as seen from line 8—8 in FIG. 2.

The illustrated retainer 36 is comprised as right and left hand pieces of spring steel wire, each with back-turned end barb 36*b* (FIG. 3) sized to be fitted into and be bound against removal from narrow track 36*t* (FIG. 8) in the inlet housing. The opposite retainer end at 36*c* is plastic capped or coated to minimize scratching the toilet bowl. Each retainer piece between the ends has a spring coil 36*s* to provide both the needed deflection for fitting over the rim 18 and needed force for firmly holding the apparatus in place on the toilet.

The defined air flow passageway 34*a* opens at inlet 38 directly to the confined toilet bowl air, and communicates with the passageway 32*a*. To keep any toilet water that might overflow the top bowl face 20 from entering into the apparatus passageway 32*a* and reaching the electrical components in the tubular passageway 32*a*, a barrier lip 39 is formed between flow passageways 34*a* and 32*a*. As the top face 20 of most operational toilet bowls will be substantially horizontal, the walls 35*h* of the air flow passageway 34*a* will likewise be horizontal; and the thickness of any water overflowing the top bowl face 20 will be limited, as it would be occurring around the entire bowl top, and would virtually never exceed the full gap between the top bowl face and the bottom of the lowered toilet seat. The barrier lip 39 has a top horizontal edge that is located vertically above the upper horizontal wall 35*h* defining the inlet opening 38, to thereby be located about even with or even higher than the bottom of the lowered toilet seat 22 and almost certainly eliminate but surely minimize water entry into the tubular passageway 32*a*.

Figure 5:
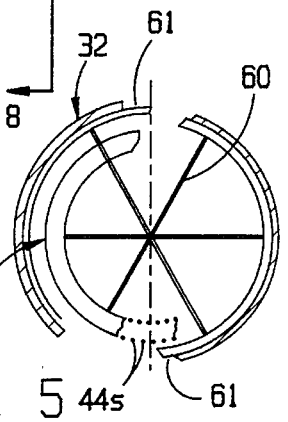
FIGS. 5 and 6 are sectional views, as seen generally from lines 5—5 and 6—6 respectively in FIG. 3.
Figure 6:
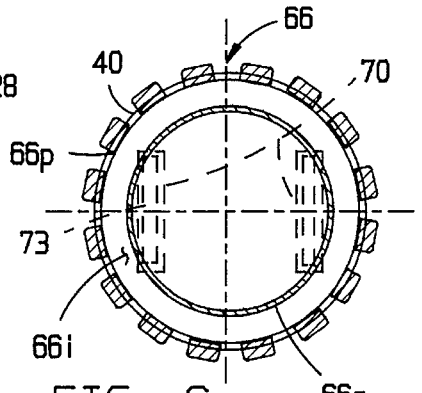
Figure 2:
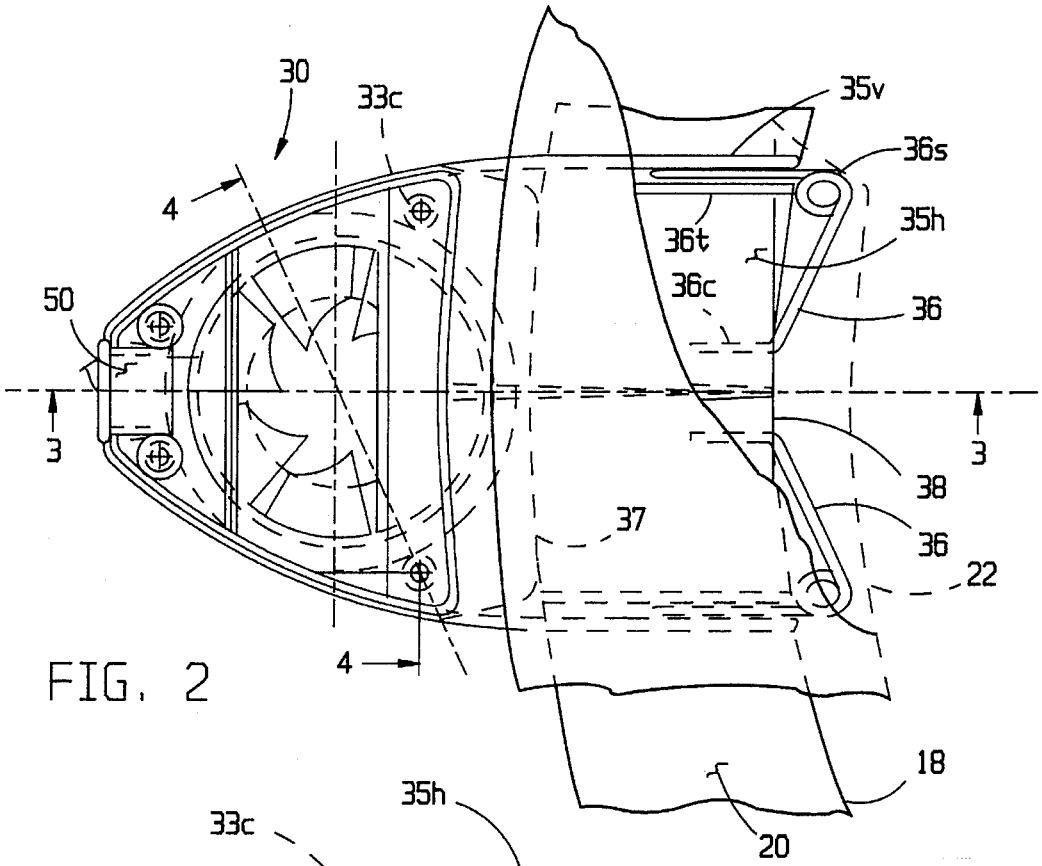
FIG. 2 is an enlarged top plan view of the inventive apparatus mounted for use on the toilet.
Figure 7:
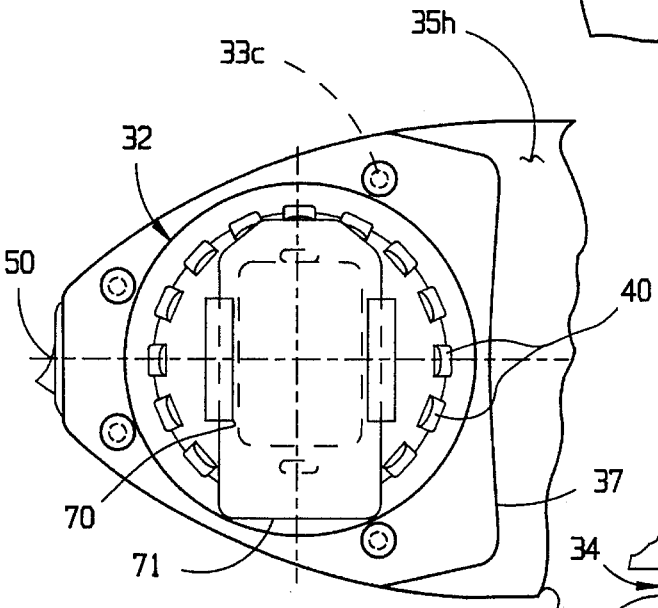
FIG. 7 is a bottom view of the inventive apparatus.

The apparatus housing 32 is generally tubular, and depends from housing 34 in general vertical alignment along the outside of the bowl 14 to the air flow outlet 40. The heater 44 therein can be of a high resistance thin wire heating element spirally coiled with adjacent turns 44*s* (FIG. 5), which spiral is itself coiled as a helix around radial forms 60 of mica or other insulation material within the tubular housing 32, with adjacent turns 44*t* being spaced from each other and the housing wall. A sheet 61 of mica or other insulation material positioned between the heater 44 and housing wall, keeps the wall temperature below its limit of integrity and/or safe to human touch.

The shaft of motor 48 is vertically aligned and upwardly extended, and the impeller of blower 46 is keyed thereto spaced above the motor. The motor support frame 62 is held generally centered in the air flow passageway 32*a* by circumferentially spaced apart radial webs 63 extended from the exterior housing wall, forming therebetween axial continuations of the passageway 32*a*, which effectively also downwardly direct the air flow over the heater 44.

A metal deflector 66 is in the air flow passageway 32*a*, adjacent the bottom housing wall 67. The central portion 66*c* of the deflector is cone shaped and is generally centered within the tubular housing, while its intermediate portion 66*i* spans the bottom wall a short distance and further its peripherial portion 66*p* is extended upwardly and overlies the housing side wall. The peripherial portion 66*p* of the deflector and the side wall of the tubular housing 32 have aligned slots or openings formed therein, comprising the outlet 40 from the passageway 32*a*.

In consideration the operation of the apparatus 30, it will be appreciated that virtually all of the odor associated with toilet use is transmitted via the air in the form of gases, emitting generally from initial confines within the toilet bowl 14. During toilet use for defecation, which as noted is the primary source of the offensive odors, the user is usually seated on the lowered seat 22, so that much of the seat opening 58 is blocked by the user's legs and buttocks. However, air and other gases can always escape from or be admitted to the bowl confines, via some gaps between the user and the seat opening and via the vertical clearance between the top bowl face 20 and the lowered seat 22.

With the apparatus 30 mounted on the toilet bowl 14 and its air flow inlet 38 opening directly to the air confined therein, operation of the blower 46 generates a negative gas pressure in the bowl. This draws the bowl air and other gases therein, including make-up air drawn into the bowl from the ambient room, through the passageways 34*a* and 32*a* and over the heater 44 for discharge from the outlet 40. The extracted bowl gases are therefore exposed to the hot surfaces of the simultaneously energized heater 44 before being discharged back to the room air. When exposed to the hot heater surfaces, the offensive toilet odors particularly associated with defecation, are neutralized or removed from the gases, which then becomes more generally odorless when discharged back to the room air.

Operation of the apparatus blower and heater is user controlled by the on-off switch 50, which can be for short or more extended durations as the need demands. Additional automatic controls (not shown) can also be incorporated, such as an automatic overheat switch for deenergizing the heater.

Heater surfaces held at temperatures exceeding approximately 450 degrees F. have proved to be effective for neutralizing the defecation odors from the passing gases, by reducing or oxidizing the gases without flame or combustion. Hotter heater surface temperatures are also effective in neutralizing the defecation odors, but several considerations must be kept in mind in using or selecting such. Thus, local building codes, or regulatory or underwriting agencies might mandate the maximum use of heating elements in related appliances to temperatures less than glowing red, making the maximum surface temperatures less than 1200–1400 degrees F. Also, some of the odorous gases might be combustible if of sufficient concentrations, air mixture and temperatures, whereby surface temperatures above approximately 1000 degrees F. possibly could be avoided. Maximum surface temperatures between 450 and 1000 degrees F. are preferred, with approximately 750 degrees F. maximum being a suited compromise for a portable appliance 30 of the type illustrated.

The gases passing over and directly exposed to the heater surfaces can thereby be heated to temperatures approaching the heated surface temperatures. The volume of such gases flow should be at a rate to provide approximately between 5–100 turnovers per minute of the confined bowl gases. It will be appreciated the greater the air turnover, the less free migration of bowl air out of the bowl confines other than through the appliance. The treated gases can be discharged back to the ambient air at temperatures in the range between 150–400 degrees F. This range can be of particular concern with the portable appliance illustrated for the safety of a person or pet animal that could come in contact with the appliance exterior and/or discharged treated air.

Additional considerations such as power requirements for the electric heating elements, the room heating effect caused by the discharge of treated gases back to the room air, the overall size of the appliance, and the noise of the blower in moving the treated gases through the appliance all might dictate the overall compromise of selected parameters.

It further should be noted that the metal deflector adjacent the slot outlet openings 40 in the tubular housing becomes heated by convection from the heated gases flowing therepast before such are discharged from the appliance. The metal deflector thereby provides additional heated surfaces that the gases must pass over, which not only increases the dwell time of gas exposure to heated surfaces but further serves to cool the treated gases slightly before being remixed with the room air.

The disclosed bowl gas treatment can effectively reduce bathroom odors without chemicals, as contrasted to having them linger in the bathroom or even permeate throughout the adjacent rooms.

Notwithstanding the effectiveness of the appliance, opposed guide tracks 70 are formed on the underside of the bottom wall 67, suited to receive and support in underlying proximity to the bottom wall a removable tray 71 suited for holding scenting materials, such as is commercially available in granular form. A metal disc 72 underlying the deflector 66 will be heated during appliance use, and openings 73 in the housing bottom wall will expose the heated disc to the tray and scenting material therein. Although use of this scenting tray is optional, it will provide effective scent release automatically when heated by the operating appliance.

While a specific embodiment has been illustrated, it will be obvious that minor changes could be made therefrom without departing from the spirit of the invention. Accordingly, the invention is to determined by the scope of the following claims.

What is claimed is:

1. Apparatus for minimizing or eliminating defecation related odors emitted from a toilet bowl, comprising the combination of body structure defining a through passageway between inlet and outlet openings;

the inlet opening being open directly to gases in the toilet bowl confines and the outlet opening being open to the ambient air outside of the toilet bowl;

air moving means in the passageway suited for drawing bowl gases via the inlet opening through the passageway and discharging the same via the outlet opening;

an electric heater in the passageway, and said heater having surfaces heated to temperatures above 450 degrees F., operable for heating the bowl gases flowing in the passageway;

a secondary deflector traversing the passageway between the electric heater and outlet opening and having a peripheral portion having openings therein and defining the outlet opening from the passageway; and said deflector further having a cone shaped central portion spaced from the peripheral portion and positioned within the passageway, and being of metal for serving as a heat sump heated by the passing bowl gases and thereby concurrently increasing the dwell time exposure of bowl gases to hot surfaces before being discharged from the outlet opening at lesser temperatures than proximate the heater.

2. Apparatus according to claim 1, further comprising the body structure being separate from the toilet bowl as a portable accessory, the body structure being defined near the inlet opening by a generally flattened scoop and by a tube downwardly disposed from the scoop toward the outlet opening, the scoop being operable to be interposed between a toilet bowl top face and an underlying lowered toilet seat face, retainer means for removably holding the scoop body structure on the toilet bowl against the top bowl face with the tube snugged against the toilet bowl outside, and said retainer means comprising right and left hand pieces of spring steel wire, each piece having at one end back-turned barb means sized to be fitted into and be bound against removal from narrow channel means in the body structure and having its opposite end covered with nonscratching plastic suited to butt against the underside of the toilet bowl rim.

3. Apparatus according to claim 1, further comprising each retainer piece between the ends having a coil to provide both the needed deflection for fitting over the toilet bowl rim and needed force for firmly but removably holding the accessory apparatus in place on the toilet.

4. Apparatus according to claim 1, further comprising spaced track means on the body structure suited to hold an optional container of scent material, and means including the secondary deflector suited to be heated by the heated gases in the passageway and a heat path therefrom to proximate the track means and container positioned thereon so as to heat the container for increased scent release.

5. Apparatus for minimizing or eliminating defecation related odors emitted from a toilet bowl, comprising the combination of body structure defining a through passageway between inlet and outlet openings;

the inlet opening being open directly to gases in the toilet bowl confines and the outlet opening being open to the ambient air outside of the toilet bowl;

air moving means in the passageway suited for drawing bowl gases via the inlet opening through the passageway and discharging the same via the outlet opening;

an electric heater in the passageway, and said heater having surfaces heated to temperatures above 450 degrees F., operable for heating the bowl gases flowing in the passageway;

the body structure being separate from the toilet bowl as a portable accessory, the body structure being defined near the inlet opening by a generally flattened scoop and by a tube downwardly disposed from the scoop toward the outlet opening, the scoop being operable to be interposed between a toilet bowl top face and an underlying lowered toilet seat face; and retainer means for removably holding the scoop body structure on the toilet bowl against the top bowl face with the tube snugged against the toilet bowl outside, and said retainer means comprising right and left hand pieces of spring steel wire, each piece having at one end a back-turned barb sized to be fitted into and be bound against removal from and twisting within narrow opposed tracks in the scoop body structure and having its opposite end covered with nonscratching plastic suited to butt against an underside of the toilet bowl rim.

6. Apparatus according to claim 5, further comprising each retainer piece between the ends having coil means to provide both deflection needed for fitting over the bowl rim and for generating forces for firmly but removably holding the accessory apparatus in place on the toilet.

7. Apparatus according to claim 5, further comprising a secondary deflector traversing the passageway between the electric heater and outlet opening and having a peripheral portion having openings therein defining the outlet opening from the passageway; and said deflector further having a cone shaped central portion spaced from the peripheral portion and positioned within the passageway and further being of metal for serving as a heat sump heated by the passing bowl gases and thereby concurrently increasing the dwell time exposure of bowl gases to hot surfaces before being discharged from the outlet opening at lesser temperatures than proximate the heater.

8. Apparatus according to claim 5, further comprising spaced track means on the body structure suited to hold an optional container of scent material, and means including the secondary deflector suited to be heated by the heated gases in the passageway and a heat path therefrom to proximate the track means and container positioned thereon so as to heat the container for increased scent release.

* * * * *